US005264052A

United States Patent [19]

Kato et al.

[11] Patent Number: 5,264,052

[45] Date of Patent: * Nov. 23, 1993

[54] FE-NI ALLOY AND METHOD FOR PRODUCING THE SAME

[75] Inventors: Jun Kato; Tsuyuki Watanabe, both of Shizuoka, Japan

[73] Assignee: Yamaha Corporation, Japan

[ * ] Notice: The portion of the term of this patent subsequent to Jan. 28, 2009 has been disclaimed.

[21] Appl. No.: 778,256

[22] Filed: Oct. 17, 1991

Related U.S. Application Data

[62] Division of Ser. No. 450,038, Dec. 13, 1989, Pat. No. 5,084,111.

[30] Foreign Application Priority Data

| | | | |
|---|---|---|---|
| Dec. 14, 1988 | [JP] | Japan | 63-315646 |
| Dec. 14, 1988 | [JP] | Japan | 63-315647 |
| Jun. 27, 1989 | [JP] | Japan | 1-164582 |
| Jun. 27, 1989 | [JP] | Japan | 1-164583 |
| Jul. 4, 1989 | [JP] | Japan | 1-172509 |
| Jul. 4, 1989 | [JP] | Japan | 1-172510 |

[51] Int. Cl.[5] ..... C21D 7/00

[52] U.S. Cl. ..... 148/547; 148/556; 148/328; 148/330; 148/409; 420/87; 420/95; 420/459; 420/581

[58] Field of Search ..... 148/12.3, 12.1, 12.7 N, 148/11.5 N, 328, 330, 336, 409, 405, 419, 426, 547, 556; 420/87, 92, 94, 95, 458, 459, 581, 582

[56] References Cited

FOREIGN PATENT DOCUMENTS

| | | |
|---|---|---|
| 59-64749 | 4/1984 | Japan . |
| 63-035754 | 2/1988 | Japan . |
| 597735 | 3/1978 | U.S.S.R. . |

*Primary Examiner*—R. Dean
*Assistant Examiner*—Sikyin Ip
*Attorney, Agent, or Firm*—Ostrolenk, Faber, Gerb & Soffen

[57] ABSTRACT

In composition of Fe-Ni alloy preferably used for lead frames in production of IC, specified amount of Be is added to the basic composition for increase in mechanical strength whilst maintaining the low thermal expansion characteristic of the conventional Fe-Ni alloys.

7 Claims, 2 Drawing Sheets

FE-NI ALLOY AND METHOD FOR PRODUCING THE SAME

This is a division of application Ser. No. 07/450,038, filed Dec. 13, 1989 U.S. Pat. No. 5,084,111.

BACKGROUND OF THE INVENTION

The present invention relates to Fe-Ni alloy and method for producing the same, and more particularly relates to improvement in property of Fe-Ni alloy suited for production of lead frames used for multiple pin type integrated circuits (IC).

With recent development in the field of large scale integration circuits (LSI) and super LSI circuits, large size silicon chips are also increasingly used in these circuits and increase in size of these silicon chips is inevitably accompanied with increased heat generation in the circuits. When there is a great gap in degree of thermal expansion, between a silicon chip and a lead frame, such increased heat generation tends to pose thermal stress on the silicon chip, thereby causing breakage of the silicon chip development of cracks in the structure of the silicon chip. For these reasons, it is nowadays intensively required to make the degree of thermal expansion of a lead frame close to that of a silicon chip which is to be combined therewith, in particular in the case of lead frames used for LSI circuits and super LSI circuits.

In order to meet such a requirement, it is proposed to use an Fe-Ni alloy of low thermal expansion. For example, Japanese Patent Opening Sho. 55-119156 proposes an alloy called 42 Alloy containing 42% by weight of Ni, and Japanese Patent Opening Sho. 59-198741 discloses an alloy called Koval which contains 29% by weight of Ni and 13% by weight of Co. Another example is Koval containing 29% by weight of Ni and 17% of Co.

In production of lead frames for IC, there is a recent general trend for increase in number of pins to be planted to one lead frame. This increase in number of pins inevitably causes corresponding decrease in width of the inner lead. Conventionally, the width of an inner lead is generally in a range from 0.3 to 0.5 mm. Whereas the recent increased number of pins allow an inner lead to have a width of only 0.15 to 0.2 mm. Reduced width of the inner lead directly connects to significant lowering in its mechanical strength which tends to cause undesirable deformation of the inner lead during transportation and/or working in production. So, in addition to the above-described closeness in degree of thermal expansion, high mechanical strength of lead frames is also strongly required in practice.

A large gap in degree of thermal expansion incurs another problem. That is, during assemblage of lead frames and silicon chips in formation of a circuit, interspaces are apt to be developed between the lead frames and sealing resin due to thermal hysteresis of the lead frames and presence of such interspaces often induces malfunction of the circuit during usage. From this point of view, a lead frame is required to have good bond with sealing resin.

SUMMARY OF THE INVENTION

It is the basic object of the present invention to provide an Fe-Ni alloy having high mechanical strength with low thermal expansion.

It is another object of the present invention to provide an Fe-Ni alloy having good bond to its sealing resin.

In accordance with the basic aspect of the present invention, Fe-Ni alloy contains 26 to 55% by weight of Ni, up to 20% by weight of Co, up to 1.0% by weight of Mn, up to 0.5% by weight of Si, 0.01 to 2.0% by weight of Be and Fe in balance.

In one preferred embodiment of the present invention, the Fe-Ni alloy further contains up to 5.0% by weight of Cu.

DESCRIPTION OF THE PREFERRED EMBODIMENTS

Figure 1:
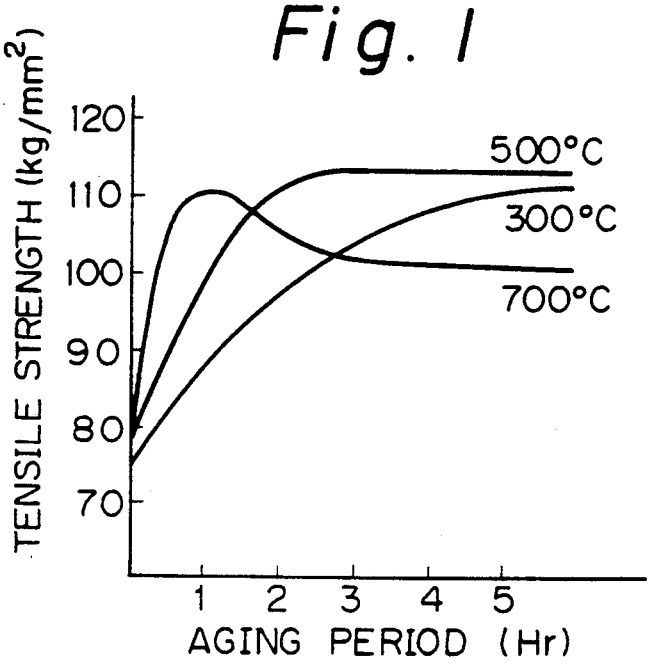
FIG. 1 is a graph for showing the relationship between the aging period and the tensile strength of alloy test pieces in one experimental test.
Figure 2:
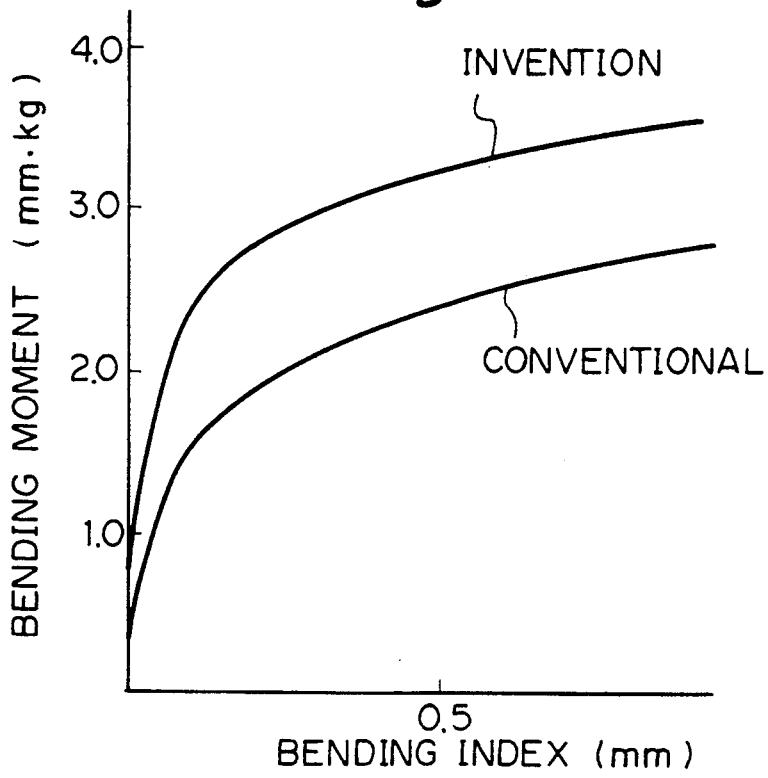
FIG. 2 is a graph for showing the relationship between the permanent-set diflection and the bending moment of alloy test pieces in another experimental test.

As stated above, the Fe-Ni alloy in accordance with the basic aspect of the present invention contains 26 to 55% by weight of Ni, up to 20% by weight of Co, up to 1.0% by weight of Mn, up to 0.5% by weight of Si, 0.01 to 2.0% by weight of Be and Fe in balance.

In one preferred embodiment of the present invention, the alloy contains 30 to 55% by weight of Ni, up to 2.0% by weight of Co. In another embodiment of the present invention, the alloy contains 26 to 34% by weight of Ni, 8 to 20% by weight of Co.

The alloy may optionally contain up to 5.0% by weight of Cu too. In the other embodiment of the present invention, the alloy contains 30 to 55% by weight of Ni, up to 2.0% by weight of Co, and up to 5.0% by weight of Cu. In the other embodiment of the present invention, the alloy contains 26 to 34% by weight of Ni, 8 to 20% by weight of Co, and up to 5.0% by weight of Cu.

When the content of Ni falls outside this range, thermal expansion of the a lead frame made of the alloy does not well fit that of silicon chips to be combined with the lead frame. Any content of Co above the upper limit would make the resultant degree of thermal expansion too large. Mn is contained to improve adaptability of the alloy to casting and to promote deoxidation. And its content above the upper limit would impair the bending characteristics of the alloy. Si is contained for the purpose of deoxidation and its content above the upper limit would make the alloy too fragile.

Addition of Be is the heart of the present invention. That is, little addition of Be raises the mechanical strength of the alloy and small content of this component is tactfully combined with presence of major components of low thermal expansion in order to keep the low thermal expansion of the obtained alloy. In addition, inclusion of Be in the starting material results in formation of a BeO layer on the surface of the product which provides a good bond with the resin used for sealing a lead frame made of the alloy. When the content of Be falls short of the low limit, no noticeable effect of addition is obtained and the crude piece is quite unsuited for the aging process. Any content above the upper limit would raise the material cost of the alloy due to the relatively high price of this component.

In production of the alloy, a mixture of the components is vacuum molten, preferably with in Ar gas environment, to form an ingot which is then subjected to repeated combinations of plastic deformation with annealing to form a crude piece, and the crude piece is subjected to aging by heating at a temperature in a range from 300° to 700° C.

Melting is preferably carried out at a temperature in a range from 1200° to 1400° C. Plastic deformation is preferably carried out at a degree of working of 70% or smaller. Annealing is preferably carried out at a temperature in a range from 800° to 1100° C. The final elongation in plastic deformation is preferably carried out at a degree of working of 50% or smaller. Heating for aging is preferably carried out for a period of 5 hours or shorter.

When the aging temperature falls short of 300° C., no sufficient aging is performed due to too small size of separated particles. When the temperature is over 700° C., the heating time necessary for the peak strength is too short to control properly and no sufficient hardening of the product can be expected due to too large size of the separated particles.

In accordance with another aspect of the present invention, the alloy further contains 0.003 to 0.050% by weight of S. Addition of small amount of S causes uniform dispersion of fine sulfide which greatly improves workability of the alloy without impairing its inherent high mechanical strength. In the other embodiment of the present invention, the alloy contains 30 to 55% by weight of Ni, up to 2.0% by weight of Co, up to 5.0% by weight of Cu and 0.003 to 0.05% by weight of S. In a further embodiment of the present invention, the alloy contains 26 to 34% by weight of Ni, 8 to 20% by weight of Co, up to 5.0% by weight of Cu and 0.003 to 0.05% by weight of S.

Any content of S below the lower limit would not assure appreciable effect in improvement of the workability. Whereas any content above the upper limit would make the hot workability of the obtained alloy poor.

In addition t(i) the foregoing components, the alloy of the present invention may inevitably contain impurities such as, for example, each up to 0.1% by weight of C, Al, Mg and Ca.

EXAMPLES

EXAMPLE 1

Samples Nos. 1 to 5 having the compositions shown in Table 1 were prepared to form ingots by melting in a vacuum environment of 80 Tr. containing Ar gas. Each ingot was then subjected to hot forging at a temperature in a range from 1200° to 1400° C. Next, a combination of rolling by which plastic deformation is carried out at a degree of working of 70% or smaller and annealing by gradual cooling after heating at a temperature in a range from 800° to 1100° C. was repeated several times. The final rolling was carried out at 50% degree of working to obtain a crude piece. Finally, the crude piece was subjected to aging by heating at 500° C. for 2 hours to obtain a test piece. The tensile strength in kg/mm$^2$, elongation in %, hardness in Hv and average coefficient of thermal expansion (30° to 300° C. and $\mu/\mu$ o°0 C.) of the test pieces were measured and the result is shown in Table 2.

It is clear from the results shown in Table 2 that, in the case of Samples 3 and 4 of the present invention, much improvement in tensile strength and hardness is observed. Sample 2 (comparative example with high content of Be) shows no noticeable improvement in tensile strength when compared with Sample 1 (conventional). Sample 5 (comparative example with 2.5% content of Be) shows increased tensile strength but with lowering in average coefficient of thermal expansion (ACTE).

TABLE 1

| | Composition (% by weight) | | | | | |
|---|---|---|---|---|---|---|
| Samples | Ni | Co | Be | Mn | Si | Fe |
| 1 | 40.8 | 0.3 | — | 0.5 | 0.3 | balance |
| 2 | 41.0 | 0.3 | 0.03 | 0.5 | 0.3 | balance |
| 3 | 41.2 | 0.5 | 0.2 | 0.5 | 0.3 | balance |
| 4 | 41.1 | 0.5 | 2.0 | 0.5 | 0.3 | balance |
| 5 | 41.2 | 0.5 | 2.3 | 0.5 | 0.3 | balance |

TABLE 2

| Samples | Type | Tensile strength | Elongation | Hardness | ACTE |
|---|---|---|---|---|---|
| 1 | conventional | 69.9 | 9.4 | 216 | 4.205 |
| 2 | comparative | 70.0 | 9.2 | 220 | 4.078 |
| 3 | invention | 95.3 | 6.4 | 272 | 3.771 |
| 4 | invention | 110.3 | 4.0 | 305 | 3.802 |
| 5 | comparative | 111.0 | 3.9 | 308 | 3.697 |

Regarding the Samples of the present invention, the relationship between the aging period and the tensile strength was investigated and the result is shown in FIG. 1. It is clear from this graphical data that the tensile strength increases gradually with increase in aging period and reaches at the peak strength at the period of 5 hours when heated at 300° C. The peak is reached at the period of about 2 hours when heated at 500° C. When heated at 700° C., the peak is reached at the period of about 1 hour but decreases thereafter. On the basis of this information, the temperature range from 300° to 700° C. is employed in the present invention.

Bending tests were carried out using Sample 3 of the present invention and Sample 1 of the conventional art. In the test, each test piece was fixedly held at one end in a horizontal position and a vertical load was applied to the other end to measure the degree of change in level of that end (permanent-set diflection). It is clearly seen in the graph that reduced permanent-set diflection is exhibited by the test piece of the present invention.

EXAMPLE 2

Samples Nos. 6 to 11 were prepared in a manner almost same as that in Example 1 but with compositions shown in Table 3. Finally, the test pieces subjected to annealing at 600° C. for a period of 1 minute are obtained. The results of measurement of the ACTE of the test pieces are shown in Table 4.

TABLE 3

| | Composition (% by weight) | | | | | | |
|---|---|---|---|---|---|---|---|
| Samples | Ni | Co | Be | Mn | Si | Cu | Fe |
| 6 | 40.8 | 0.3 | — | 0.5 | 0.2 | — | balance |
| 7 | 41.2 | 0.4 | 0.008 | 0.4 | 0.3 | 0.3 | balance |
| 8 | 40.0 | 0.2 | 0.01 | 0.3 | 0.4 | 0.5 | balance |
| 9 | 41.8 | 0.5 | 0.03 | 0.4 | 0.3 | 0.4 | balance |
| 10 | 41.1 | 0.3 | 0.05 | 0.3 | 0.4 | 0.3 | balance |

TABLE 3-continued

| Samples | Composition (% by weight) | | | | | | |
|---|---|---|---|---|---|---|---|
| | Ni | Co | Be | Mn | Si | Cu | Fe |
| 11 | 41.0 | 0.4 | 0.06 | 0.5 | 0.4 | 0.5 | balance |

TABLE 4

| Samples | Type | ACTE ($\times 10^{-6}$) |
|---|---|---|
| 6 | conventional | 4.108 |
| 7 | comparative | 4.052 |
| 8 | invention | 3.921 |
| 9 | invention | 3.842 |
| 10 | invention | 4.023 |
| 11 | invention | 4.120 |

As is clear from the data in Table 4 it is clear that the average coefficient of thermal expansion (ACTE) of the test pieces in accordance with the present invention is maintained almost same as that of the test pieces of the conventional art.

Figure 3:
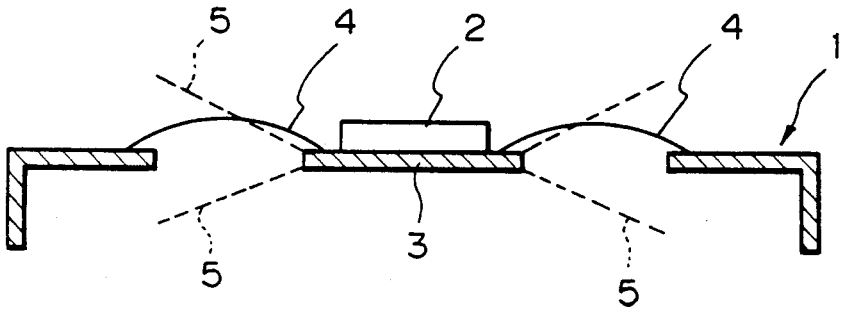
FIG. 3 is a sectional side view of a lead frame subjected to resin bonding test in one Example of the present invention.

Next, each test piece was subjected to a resin bonding test. The test piece was used as a lead frame provided with 100 pins arranged in a radial disposition. After mounting of silicon chips and electric connection, the lead frame was packed with low stress resin for sealing purposes. The sealed lead frame was left in an environment of 85° C. temperature and 80% relative humidity for up to 32 hours for humidity absorption. Next, the lead frame was immersed in a solder bath of 240° C. for 3 times (10 seconds for each time). Thereafter, presence of internal cracks was detected via supersonic investigation. The arrangement of the test piece subjected to the investigation is shown in FIG. 3. In the illustration, 1 indicates a lead frame, 2 an IC chip, 3 a pad of the lead frame mounted with the IC chip 2, 4 are lead wired and 5 cracks developed in the sealing resin. Development of such internal cracks often causes breakage of the lead wires sealed by the resin. The results of the bonding test are shown in Table 5 in which "o" indicates no presence of internal cracks and "x" indicates present of internal cracks.

Samples 8 to 11 of the present invention indicate that no development of internal cracks is observed when absorption of humidity is shorter than 8 hours. When Be is added as in Samples 10 and 11, no internal crack are developed even by 16 hours of humidity absorption.

TABLE 5

| Sample | Type | Humidity absorption (Hr) | | | | |
|---|---|---|---|---|---|---|
| | | 0 | 4 | 8 | 16 | 32 |
| 6 | conventional | o | x | x | x | x |
| 7 | comparative | o | x | x | x | x |
| 8 | invention | o | o | o | x | x |
| 9 | invention | o | o | o | x | x |
| 10 | invention | o | o | o | o | x |
| 11 | invention | o | o | o | o | x |

EXAMPLE 3

Samples Nos. 12 to 17 were prepared in a manner same as that in Example 1 but with compositions shown in Table 6.

TABLE 6

| Sample | Composition (% by weight) | | | | | | | |
|---|---|---|---|---|---|---|---|---|
| | Ni | Co | Be | Mn | Si | Cu | S | F |
| 12 | 41.2 | 0.5 | 0.2 | 0.5 | 0.3 | 0.2 | — | balance |
| 13 | 41.0 | 0.4 | 0.2 | 0.5 | 0.2 | 0.1 | 0.002 | balance |
| 14 | 40.8 | 0.5 | 0.2 | 0.3 | 0.3 | 0.2 | 0.003 | balance |
| 15 | 41.1 | 0.3 | 0.2 | 0.4 | 0.3 | 0.3 | 0.008 | balance |
| 16 | 41.5 | 0.2 | 0.2 | 0.2 | 0.2 | 0.1 | 0.040 | balance |
| 17 | 40.9 | 0.4 | 0.2 | 0.3 | 0.3 | 0.1 | 0.050 | balance |

Figure 4:
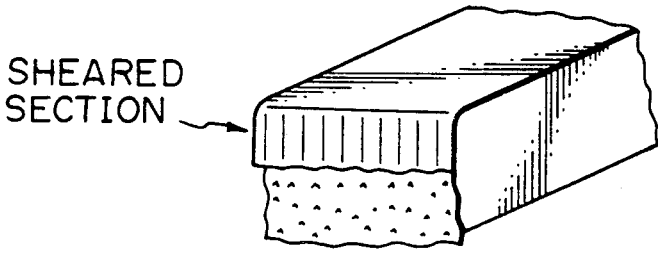
FIG. 4 is a perspective view of a test piece subjected to shearing test in on Example of the present invention.

The test pieces, 0.15 mm thickness, were subjected to a workability test in which each test piece was sheared by press and, as shown in FIG. 4 the ratio in thickness of the sheared section with respect to the entire test piece. The results are shown in Table 7.

TABLE 7

| Sample | Type | Shearing thickness ratio |
|---|---|---|
| 12 | comparative | 0.72 |
| 13 | comparative | 0.68 |
| 14 | invention | 0.50 |
| 15 | invention | 0.42 |
| 16 | invention | 0.44 |
| 17 | invention | 0.44 |

The results with Samples 14 to 17 well indicate noticeable improvement attained by the present invention.

TABLE 8

| Sample | Type | ACTE ($\times 10^{-6}$) |
|---|---|---|
| 12 | comparative | 3.771 |
| 13 | comparative | 3.943 |
| 14 | invention | 4.102 |
| 15 | invention | 3.854 |
| 16 | invention | 3.978 |
| 17 | invention | 4.023 |

The results of measurement of the ACTE of the test pieces are shown in Table 8. The results with the invention is maintained almost same as that of the conventional art.

We claim:

1. A Fe-Ni alloy, the alloy consisting essentially of: 40 to 42% by weight of Ni, up to 0.5% by weight of Co, up to 1.0% by weight of Mn, up to 0.5% by weight of Si, 0.01 to 2.0% by weight of Be and Fe in balance.

2. Fe-Ni alloy as claimed in claim 1 comprising 0.05 to 2.0% by weight of Be.

3. Fe-Ni alloy as claimed in claim 1 further comprising up to 5.0% by weight of Cu.

4. Fe-Ni alloy as claimed in claim 3 comprising 0.01 to 0.05% by weight of Be.

5. Method for producing Fe-Ni alloy consisting essentially of 26 to 55% by weight of Ni, up to 20% by weight of Co, up to 1.0% by weight of Mn, up to 0.5% by weight of Si, 0.01 to 2.0% by weight Be and Fe in balance, comprising the steps of:

melting a mixture of said components to form an ingot, subjecting said ingot to repeated combinations of plastic deformation with annealing to form a crude piece, and aging said crude piece by heating at a temperature in a range from 300° to 700° C.

6. The method of claim 5, wherein the alloy comprises 0.05 to 2.0% by weight of Be.

7. The method of claim 5, wherein the alloy comprises up to 5.0% by weight of Cu.

* * * * *